US009616397B2

(12) United States Patent
Paust et al.

(10) Patent No.: US 9,616,397 B2
(45) Date of Patent: Apr. 11, 2017

(54) MIXER FOR INSERTION INTO A ROTOR OF A CENTRIFUGE

(71) Applicant: Hahn-Schickard-Gesellschaft fuer angewandte Forschung e.V., Villingen-Schwenningen (DE)

(72) Inventors: Nils Paust, Freiburg (DE); Felix Von Stetten, Freiburg (DE)

(73) Assignee: Hahn-Schickard-Gesellschaft fuer angewandte Forschung e.V., Villingen-Schwenninge (DE)

( * ) Notice: Subject to any disclaimer, the term of this patent is extended or adjusted under 35 U.S.C. 154(b) by 410 days.

(21) Appl. No.: 14/287,373

(22) Filed: May 27, 2014

(65) Prior Publication Data

US 2014/0251886 A1 Sep. 11, 2014

Related U.S. Application Data

(63) Continuation of application No. 13/624,085, filed on Sep. 21, 2012, now abandoned, which is a continuation of application No. PCT/EP2011/054115, filed on Mar. 18, 2011.

(30) Foreign Application Priority Data

Mar. 24, 2010 (DE) ..... 10 2010 003 224

(51) Int. Cl.

| | |
|---|---|
| ***B01F 9/06*** | (2006.01) |
| ***B01F 7/00*** | (2006.01) |
| ***B01F 9/00*** | (2006.01) |
| ***B01F 15/00*** | (2006.01) |

(52) U.S. Cl.

CPC ..... *B01F 7/00016* (2013.01); *B01F 9/0003* (2013.01); *B01F 9/06* (2013.01); *B01F 15/0085* (2013.01); *B01F 2009/0094* (2013.01)

(58) Field of Classification Search

CPC ..... B01F 9/06
USPC ..... 422/415; 494/16
See application file for complete search history.

(56) References Cited

U.S. PATENT DOCUMENTS 2,198,256 A * 4/1940 Levy ..... B01L 3/5021 241/DIG. 30
2,507,309 A * 5/1950 Larsson ..... B04B 5/0414 494/16
3,401,876 A * 9/1968 Lucas ..... B04B 5/0421 494/10

(Continued)

OTHER PUBLICATIONS

Von Stetten et al.; "Device for Insertion Into a Rotor of a Centrifuge, Centrifuge and Method for the Fluidic Coupling of Cavities"; U.S. Appl. No. 13/624,079, filed Sep. 21, 2012.

(Continued)

*Primary Examiner* — David Sorkin
(74) *Attorney, Agent, or Firm* — Keating & Bennett, LLP

(57) ABSTRACT

A mixer for insertion into a rotor of a centrifuge has a mixing trough and an obstacle device with at least one obstacle. The at least one obstacle is configured in order to influence the flow of a liquid present in the mixing trough. In response to a rotation of the rotor, with a specified incorporation of the mixer in a holder of the rotor, a spacing between at least one wall section of the mixing trough and the obstacle device is variable such that the liquid present in the mixing trough flows around the obstacle of the obstacle device.

21 Claims, 12 Drawing Sheets

(56) References Cited

U.S. PATENT DOCUMENTS 4,857,187 A * 8/1989 Ito ..... B01D 15/08
210/198.2

OTHER PUBLICATIONS

Paust et al., "Mixer for Insertion Into a Rotor of a Centrifuge", U.S. Appl. No. 13/624,085, filed Sep. 21, 2012.

* cited by examiner

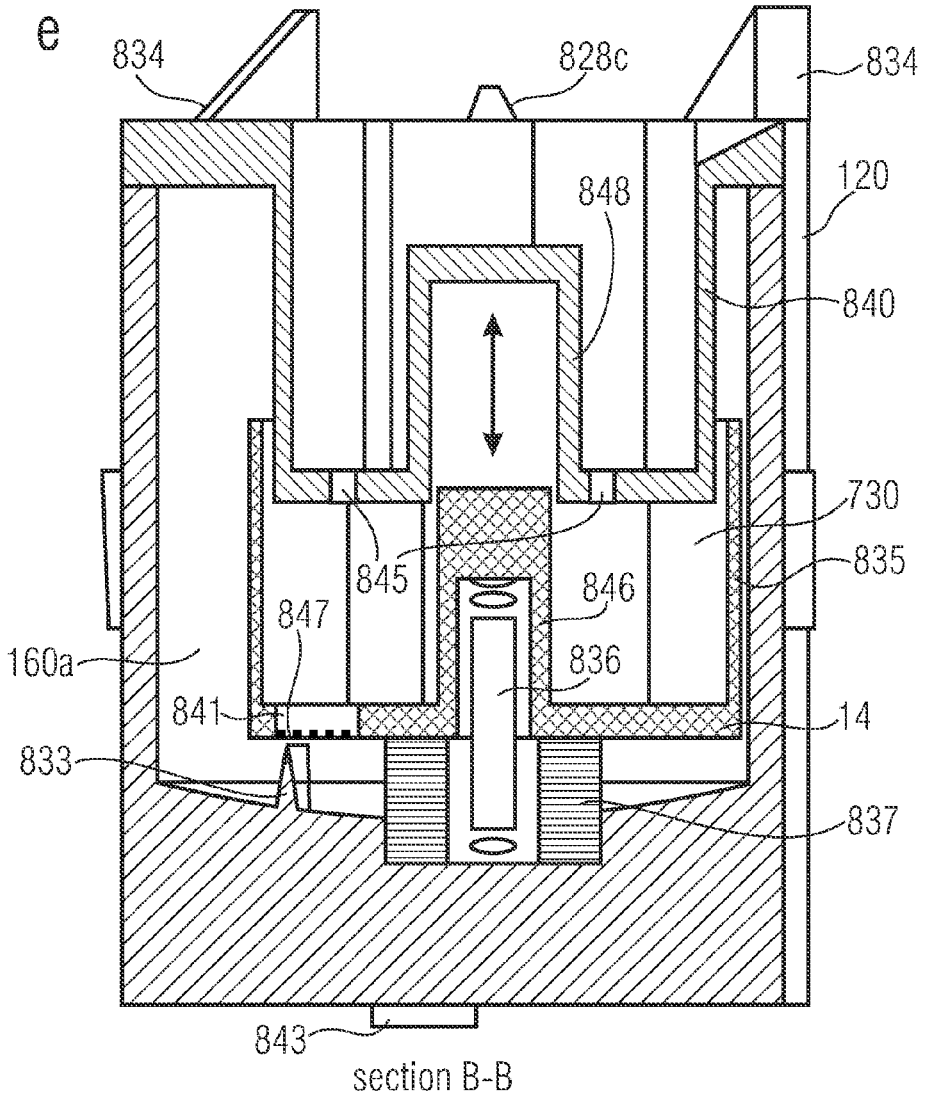
FIGURE 7C-E

MIXER FOR INSERTION INTO A ROTOR OF A CENTRIFUGE

CROSS-REFERENCE TO RELATED APPLICATIONS

This application is a continuation of copending International Application No. PCT/EP2011/054115, filed Mar. 18, 2011, which is incorporated herein by reference in its entirety, and additionally claims priority from German Application No. 102010003224.7-23, filed Mar. 24, 2010, which is also incorporated herein by reference in its entirety.

BACKGROUND OF THE INVENTION

Embodiments of the present invention relate to a mixer for inserting into a rotor of a centrifuge, for example a standard laboratory centrifuge.

The implementation of (bio)chemical processes involves handling of liquids. An important process step herein is the mixing of different liquids such as, for example, in a reaction vessel. A mixing process occurs, for example, in a reaction vessel that is inserted into a centrifuge. Correspondingly, two different liquids can be mixed in a reaction vessel, for example, in a glass tube or a plastic tube. To blend the two liquids, said tube is then placed in the centrifuge and centrifuged. A disadvantage of using such standard reaction vessels for blending liquids is that, due to the inertia of standard centrifuges, the mixing process, particularly when blending liquids of different densities, does not take place at all or is at least not complete.

SUMMARY

According to an embodiment, a mixer for insertion into a rotor of a centrifuge may have: a mixing trough; and an obstacle device with at least one obstacle, which is configured such as to influence a flow of a liquid present in the mixing trough; wherein in response to a rotation of the rotor, with a specified incorporation of the mixer in a holder of the rotor, a spacing between at least one wall section of the mixing trough and the obstacle device is variable such that a liquid that is present in the mixing trough flows around the at least one obstacle of the obstacle device.

Embodiments of the present invention provide for a mixer that is inserted in a rotor of the centrifuge. The mixer therein includes a mixing trough and an obstacle device with at least one obstacle that is configured such as to influence a flow of a liquid that is located inside the mixing trough. Responding to a rotation of the rotor and upon a correct reception of the mixer in a holder (for example, a tilt cup holder) of the rotor, a distance between a wall section of the mixing trough and the obstacle device is variable. The liquid in the mixing trough therein circumflows the obstacle device.

The core idea of the present invention envisions that it is possible to provide a better concept for blending liquids if a reaction vessel includes a mixer that has movable elements that facilitate the mixing of the liquids inside the reaction vessel by utilizing centrifugal forces, which are generated by the rotor. It was found that providing a circumflow-action around an obstacle inside the reaction vessel allows for achieving a mixing effect of the liquids. Flowing around the obstacle creates a redirection of the liquids, resulting in a large contact area within the liquids or substances, thus allowing the two to be blended into each other.

Embodiments of the present invention thereby allow for blending liquids based on a rotation of the rotor, which means on the basis of a centrifugal force that is generated by the rotor.

According to some embodiments, the distance between the wall section of the mixing trough and the obstacle device can be modified as a function of the angular velocity of the rotor of the centrifuge. In other words, embodiments of the present invention allow for blending liquids based on the angular velocity of the rotor, wherein changing the angular velocity of the rotor causes one or several liquids to be able to flow around the at least one obstacle multiple times in order to thereby achieve a mixing effect.

According to some embodiments of the present invention, a mixer can include restoring means. The restoring means is configured such therein as to generate a restoring force that acts in the opposite direction of at least one component of a centrifugal force that is generated by the rotation of the rotor. With a receptacle of the mixer in a rotor of a decay centrifuge and a maximum decay of the mixer, the restoring force acts directly against the centrifugal force. With a reception of the mixer in a rotor of a fixed-angle centrifuge, the restoring force acts counter to a component of the centrifugal force, with the amount of the same being a function of the angular velocity of the rotor and the angle of the holder of the rotor in relation to the axis of rotation of the rotor. The restoring means is configured such that in a first phase, at a first angular velocity of the rotor, a first amount of the component of the centrifugal force acting in the direction opposite to the restoring forces is greater than the amount of the restoring force. In a second phase, at a second angular velocity of the rotor, a second amount of the component of the centrifugal force acting in the direction opposite to the restoring force is smaller than the amount of the restoring force. In other words, the amount of the restoring force that is generated by the restoring means can be independent of the angular velocity of the rotor. In the first phase, a first distance of the wall section of the mixing trough relative to the obstacle device is greater than a second distance of the wall section of mixing trough relative to the obstacle device in the second phase. In the first phase, a liquid, or at least a part of the liquid, located inside the mixer therein circumflows the at least one obstacle of the obstacle device in a first direction. In the second phase, the liquid, or at least a part of the liquid, located inside the mixer circumflows the at least one obstacle of the obstacle device in a second direction, which is contrary to the first direction. The repeated circumflow-action of the liquid around the obstacle creates a mixing effect of the liquid that is present inside the mixer or of the liquid mixture that is present inside the mixer. Embodiments of the present invention thereby make it possible to blend different liquids based on the angular velocity of the rotor of a centrifuge.

According to some embodiments, the restoring means can be configured as a spring.

According to some further embodiments, the wall section of the obstacle device can be an elastic membrane, and the elastic membrane itself can constitute the restoring means. The elastic membrane therein can act in the way of a pump; meaning, in the first phase, the elastic membrane is, based on the centrifugal force, radially stretched toward the outside (away from an axis of rotation of the rotor), and, in the second phase, the membrane radially contracts, due to the generated restoring force, toward the inside (toward the axis of rotation of the rotor), and thereby presses the liquid past at least one obstacle of the obstacle device.

According to some further embodiments in which the restoring means is configured as a spring, it is possible for the mixing trough to be movably supported in the mixer, for example, in relation to a housing, wherein, in the first phase, the mixing trough radially moves toward the outside and, in the second phase, based on the restoring force that is generated by the spring, radially toward the inside in order press the liquid past at least the one obstacle of the obstacle device. The liquid therein moves in the first phase from a first location that is radially further inside to a second location that is radially further outside. In the second phase, the liquid moves from the second location that is radially further outside to the first location that is radially further inside.

According to some further embodiments wherein the restoring means can be constituted by a spring, the mixing trough can be fixedly locked in place in the mixer such as, for example, to a housing of the mixer. The obstacle device therein can be movably disposed in the mixing trough. The spring therein can be disposed, for example, between the wall section of the mixing trough and the obstacle device. In the first phase, the obstacle device moves, based on the centrifugal force, radially toward the outside (meaning quasi through the liquid that is present in the mixing trough), and in the second phase, the obstacle device moves, based on the restoring force that is generated by the spring, radially toward the inside.

BRIEF DESCRIPTION OF THE DRAWINGS

Embodiments of the present invention will be detailed subsequently referring to the appended drawings, in which.

DETAILED DESCRIPTION OF THE INVENTION

Before explaining the invention in further detail below, it is noted that same elements or functionally same elements in the figures are identified by identical reference symbols thus omitting any repetition of the description of said elements. Descriptions of elements having identical reference symbols are, therefore, interchangeable and/or applicable to each other in different embodiments.

Figure 1:
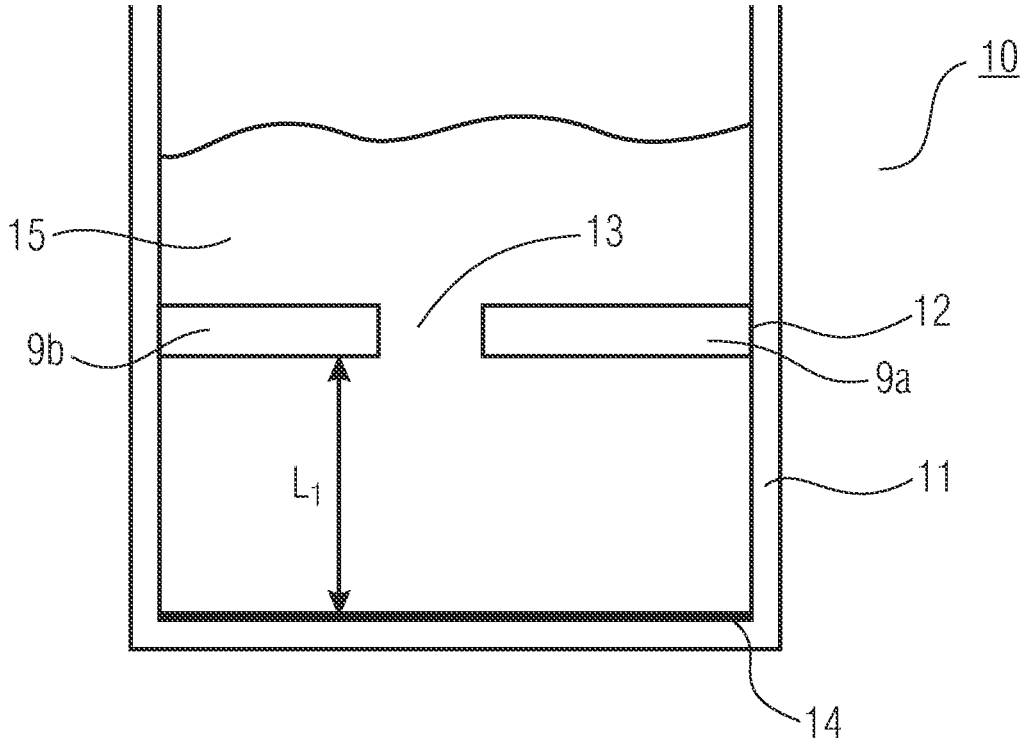
FIG. 1 is a schematic representation of a mixer according to one embodiment of the present invention.

FIG. 1 is a schematic depiction of a mixer 10 according to an embodiment of the present invention. Mixer 10 for insertion into a rotor of a centrifuge includes a mixing trough 11 and an obstacle device 12 having a first obstacle 9*a* and a second obstacle 9*b*. The mixer 10 has a passage opening 13 between the first obstacle 9*a* and the second obstacle 9*b*.

The two obstacles 9*a* and 9*b* are configured such that they influence a flow of a liquid 15 that is present inside the mixing trough 11. According to further embodiments, the obstacle device can include only one obstacle or a plurality of obstacles. An obstacle can consist of, for example, a bollard, a part of a rake (for example, a tine of a rake), a frame or rim of a passage opening (as shown in an exemplary manner in FIG. 1), or something similar.

A distance $L_1$ between a wall section 14 of the mixing trough 11 and the obstacle device 12 is variable and responds to a rotation of the rotor upon a correct reception of the mixer 10 in a holding means of the rotor, resulting in the liquid 15 that is present in the mixing trough 11 to flow around the obstacles 9*a* and 9*b* of the obstacle device 12. The liquid 15 therein flows through the passage opening 13 of the obstacle device 12.

The distance $L_1$ between the wall section 14 of the mixing trough 11 and the obstacle device 12 therein can be a function of the angular velocity of the rotor of the centrifuge. Any mixing action of the liquid 15 that is present in the mixing trough 11 can thus be achieved by a change of the angular velocity of the rotor, wherein the liquid 15 therein flows multiple time through the at least one passage opening 13 of the obstacle device 12 (in opposite directions, respectively), thereby flowing around obstacles 9*a*,9*b* of the obstacle device 12 multiple times. The flow-through action of the liquid 15 through the passage opening 13 (and the related flow-around action of obstacles 9*a*, 9*b* of the obstacle device 12) produces a mixing effect of the liquid 15.

According to some embodiments, as shown in FIG. 1, the wall section 14 of the mixing trough 11 can constitute a floor of the mixer 10 and can be disposed therein radially further to the outside than the obstacle device 12 during a rotation of the mixer in the rotor of the centrifuge.

According to some embodiments, as shown in FIG. 1, it is possible for the obstacle device 12 to be disposed inside the mixing trough 11. The obstacle device 12 therein can be movably disposed inside the mixing trough 11 or locked in place inside the mixing trough 11 (for example, to the rim of the mixing trough 11).

According to some embodiments, the obstacle device can be mechanically coupled to the mixing trough 11.

Figure 2A:
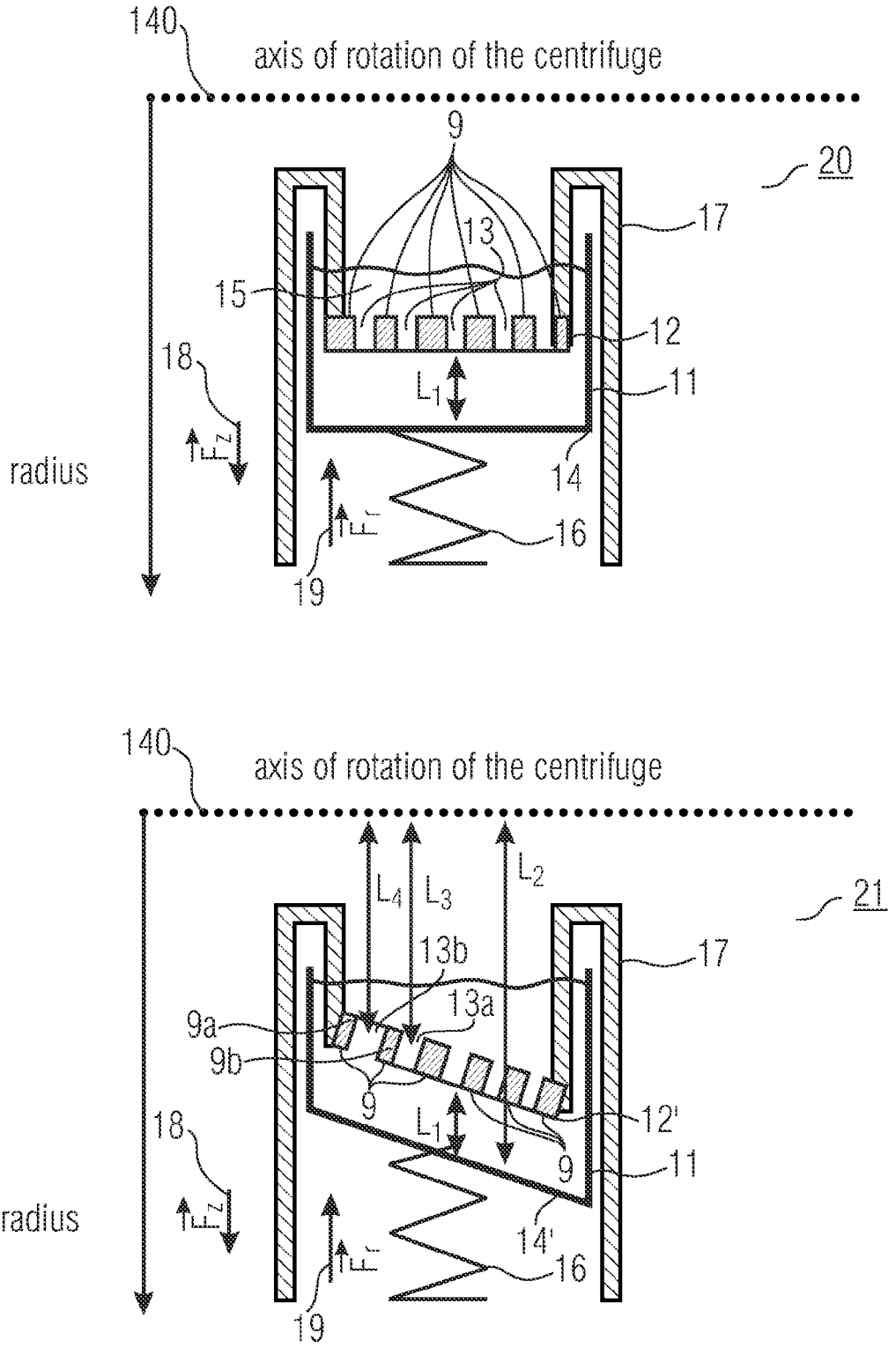
FIGS. 2*a* and 2*b* are schematic representations of embodiments according to the present invention.

FIG. 2*a* shows two mixers according to embodiments of the present invention.

A mixer 20 as shown in FIG. 2*a*, upper includes, as demonstrated on the mixer 10 that is depicted in FIG. 1, a mixing trough 11 with a wall section 14 and an obstacle device 12. The mixer 20 as shown in FIG. 2*a*, upper differs from the mixer 10 as shown in FIG. 1 in that the obstacle device 12 includes a plurality of passage openings 13 (FIG. 2*a*, upper shows five passage openings 13), thus having a plurality of obstacles 9. The schematic depiction of mixer 20 as represented in FIG. 2*a*, upper can be, for example, a sectional view of the mixer 20. The obstacle device 12 can, therefore, have further passage openings 13 and obstacles 9 that are not shown here. The obstacles 9 therein can be configured such that the passage openings 13 can be constituted, for example, by way of holes or strips. Moreover, the mixer 20 includes a housing 17, which has the obstacle device 12 disposed therein. The mixing trough 11 is movably supported by a spring 16 inside the housing 17; and the spring 16 therein constitutes the restoring means. The spring 16 can be disposed, for example, between the wall section 14 of the mixing trough 11 and a floor (not shown here) of the housing 17. The variable distance between the wall section 14, which can be, for example, a floor of the mixing trough 11, and the obstacle device 12 is embodied in the mixer 20 as shown in FIG. 2*a*, upper such that, during a rotation of the mixer 20 around an axis of rotation 140 of the rotor of the centrifuge, a centrifugal force $F_z$ that is generated by the rotation counteracts a restoring $F_r$ that is generated by the spring 16. If the centrifugal force $F_z$, which is generated by the rotation of the rotor, is greater than the restoring $F_r$, which is generated by the spring 16, the mixing trough 11 radially moves toward the outside, and thereby away from the obstacle device 12, which means the distance $L_1$ between the wall section 14 and the obstacle device 12 becomes greater. A liquid 15 that is present in the mixing trough 11 is thereby, due to the centrifugal force, pressed through the passage openings 13 of the obstacle device 12 or flows through the same. By flowing around the obstacles 9 of the obstacle device 12, meaning the rims, respectively, of the passage openings 13, blending of the liquid 15 is implemented. The liquid 15 thus flows from a radially more inside location (from a location that is at a smaller distance in relation to the axis of rotation 140 of the rotor) to a radially more outside location (at a greater distance in relation to the axis of rotation 140). The phase in which the centrifugal force $F_z$ is greater than the restoring force $F_r$ can be designated as a first phase of the mixer 20.

If the centrifugal force $F_z$ is smaller than the restoring force $F_r$ (for example, if the angular velocity of the rotor is smaller than in the first phase), the mixing trough 11 moves toward the obstacle device 12, thereby reducing the distance $L_1$ between the obstacle device 12 and the wall section 14 of the mixing trough 11. The liquid 15 that is present in the mixing trough 11 is thereby pressed once again through the passage openings 13 of the obstacle device 12, thus producing further blending due to the circumflowing action around obstacles 9 (of the rims of passage openings 13) of the obstacle 12. A phase when the restoring force $F_r$ is greater than the centrifugal force $F_z$ can also be designated as the second phase of the mixer 20.

This raising and lowering and/or moving of the mixing trough 11 from a radially more inside location to a radially more outside location can be repeated multiple times during a mixing process; for example, based on an alternating rotary frequency of the rotor of the centrifuge. In other words, the alternating rotary frequency of the centrifuge can be utilized to control the circumflowing action around the obstacle device 12 (of obstacles 9), and thereby the flow-through of liquid 15 through the passage openings 13 of the obstacle device 12.

In other words, a flexible component (the mixing trough 11) moves in relation to a stationary component (the obstacle device 12). This forces the liquid (liquid 15) to flow around the stationary component (the obstacle device 12 having obstacles 9 and passage openings 13). In the embodiment as shown in FIG. 2*a*, upper, the flexible component is embodied by a mixing trough 11 that is supported on a spring 16. During rotation of the centrifuge (the rotor of the centrifuge), the centrifugal force causes a displacement of the flexible components (the mixing trough 11) from a location that is arranged radially further to the inside to a location that is arranged radially further to the outside. During displacement, a force (the restoring force $F_r$ generated by the spring) is generated on the movable element (the mixing trough 11) that acts in opposition to the centrifugal force $F_z$.

A first arrow 18 in FIG. 2*a*, upper indicates a direction of action of the centrifugal force Fz and an amount of the centrifugal force $F_z$. A second arrow 19 indicates a direction of action of the restoring force $F_r$ that is generated by spring 16 as well as an amount of the restoring force $F_r$. A length of arrows 18, 19 therein represents the size of the amount of the respective force. Therefore, the length of the two arrows 18 and 19 in FIG. 2*a*, upper shows that an amount of the restoring force $F_r$ is greater than an amount of the centrifugal force $F_z$. The mixer 20 is therefore in its second phase, as described above and as shown in the schematic representation of mixer 20 in FIG. 2*a*.

FIG. 2*a*, lower shows a mixer 21 according to a further embodiment of the present invention. The mixer 21 differs from the mixer 20 as shown in FIG. 2*a*, upper such that a wall section 14', arranged at a distance $L_1$ that is variable in relation to an obstacle device 12', is disposed at an incline. In other words, a distance $L_2$ between the axis of rotation 140 of the rotor of the centrifuge and the wall section 14' is variable along the direction of expansion of the wall sections 14' at a given angular velocity of the rotor is variable such as, for example, from a right edge of the mixing trough 11 to a left edge of the mixing trough 11. Correspondingly, distance $L_2$ from the wall section 14' to the axis of rotation 140 of the rotor on the right edge of the mixing trough 11 can be greater than on the left edge of the mixing trough 11. A configuration of the wall section 14', as shown in FIG. 2*a*, lower can result, in particular, in a better blending action of liquids with different densities.

Further, in the mixer 21 as shown in FIG. 2*a*, lower, the obstacle device 12' is also disposed at an incline inside the mixer 21. This means a distance $L_3$ from a first passage opening 13*a* to the axis of rotation 140 of the rotor of the centrifuge is different (in the embodiment as shown in FIG. 2*a*, lower, it is greater) than a distance $L_4$ from a second passage opening 13*b* to the axis of rotation 140 of the rotor. In other words, a first distance of a first obstacle 9*a* in relation to an axis of rotation 140 of the rotor is different from a second distance of a second obstacle 9*b* in relation to an axis of rotation 140 of the rotor. In one direction of expansion, the obstacle device 12' can, such as, for example, from a right side of the obstacle device 12' to a left side of the obstacle device 12', run parallel in relation to the wall section 14' of the mixing trough 11. In addition, the passage openings 13 have different cross-sections, meaning, for example, different-size diameters of the openings. For example, one cross-section of an opening of the first passage opening 13*a* can be smaller than a cross-section of an opening of a second passage opening 13*b*. A first distance between two obstacles of the obstacle device 12' is thereby different in relation to a second distance between two further obstacles of the obstacle device 12'. In other words, using a defined obstacle design (of obstacle device 12' having passage openings 13), such as, for example, a slanted perforated plate (the inclined obstacle device 12'), it is possible to embody a blending action of liquids of different densities by means of different hole diameters (of the passage openings 13) or different distances between the obstacles 9 of the obstacle device 12'.

According to a further embodiments, a mixer according to an embodiment of the present invention can have only one inclined wall section 14' or inclined obstacle device 12' or different distances of the obstacles 9 in relation to each other (and thereby differing cross-sections of the passage openings 13) or a combination of these three. In different embodiments, a design of the obstacle device as well as of the obstacles thereof and/or of the passage openings and of the mixing trough can be chosen dependent on a (bio)chemical process that is to be implemented using the mixer.

Figure 2B:
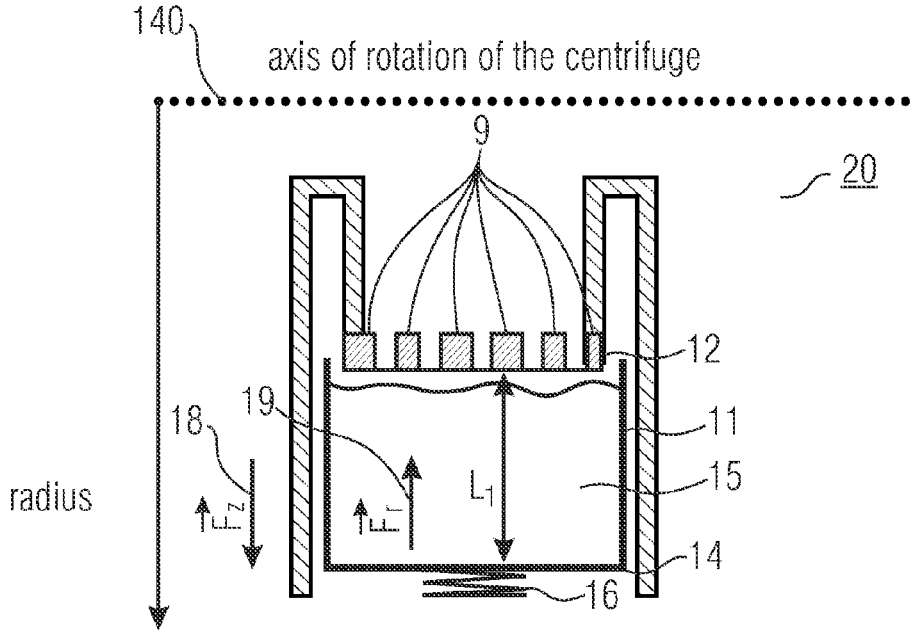
Figure 2B:
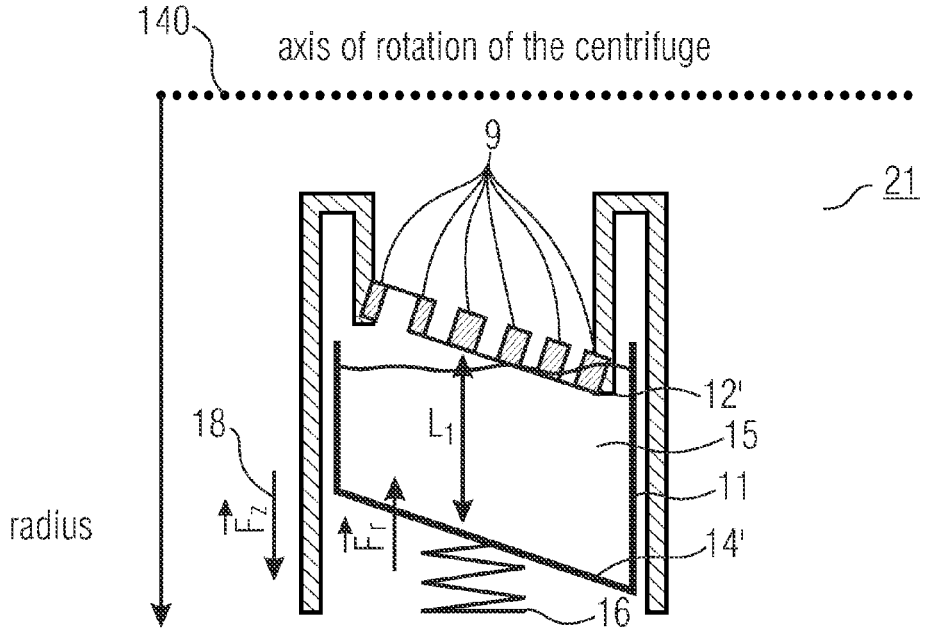

FIG. 2*b*, upper shows the mixer 20 from FIG. 2*a*, upper. In FIG. 2*a*, upper, the mixer is in a second phase, such as, for example, a phase of low angular velocity, in FIG. 2*b*, upper, however, the mixer is in a first phase, such as, for example, a phase of high angular velocity of the rotor. The length of the arrow 18 indicates that an amount of the centrifugal force $F_z$ in FIG. 2*b*, upper (meaning in the first phase) is greater than an amount of centrifugal force $F_z$ in FIG. 2*a*, upper (meaning in the second phase). It can be seen, in particular, that the amount of the centrifugal force $F_z$ in FIG. 2*b*, upper is greater than the amount of the restoring force $F_r$. A spring constant of spring 16 is independent therein of the angular velocity of the rotor.

Due to the fact that the centrifugal force $F_z$ is greater than the restoring force $F_r$, in FIG. 2*b* upper, the mixing trough 11, and thereby mixing trough section 14, is located radially further to the outside than in FIG. 2*a*, upper. In other words, the distance $L_1$ between the wall section 14 of the mixing trough 11 and the obstacle device 12 in FIG. 2*b*, upper is greater in the second phase than in FIG. 2*a*, upper in the first phase. The greater centrifugal force $F_z$ in the second phase can be achieved herein by the higher angular velocity of the rotor in relation to the first phase. Due to the increased centrifugal force, the mixing trough 11 moves, as mentioned previously, to a location that is radially more to the outside, and with it moves liquid 15 which therein flows through the passage openings 13 of the obstacle device 12 circumflowing the obstacles of the obstacle device 12. The spring 16 is compressed during this step.

Although in the embodiment as shown in FIG. 2*b*, upper the obstacle device 12 is completely retracted from the mixing trough 11 and no longer in contact with the liquid 15, according to further embodiments, the mixing trough 11 can be configured such that even with a maximum displacement of the mixing trough 11 in relation to the obstacle device 12, the obstacle device 12 is not retracted from the mixing trough 11.

FIG. 2*b*, lower shows, analogously to FIG. 2*b*, upper, the mixer 21 in a first phase in which an amount of the centrifugal force $F_z$ that is generated by the rotation of the rotor is greater than the amount of the restoring force $F_r$ that is generated by spring 16. In FIG. 2*b*, lower, the distance $L_1$ between the wall section 14' and the obstacle device 12' is also greater than the distance $L_1$ between the wall section 14' and the obstacle device 12' in FIG. 2*a*, lower. The spring 16 is compressed herein as well.

In terms of function, the mixer 21 does not differ from mixer 20. However, as described previously, the mixer 21 can be used, in particular, for blending liquids of different densities.

Figure 3:
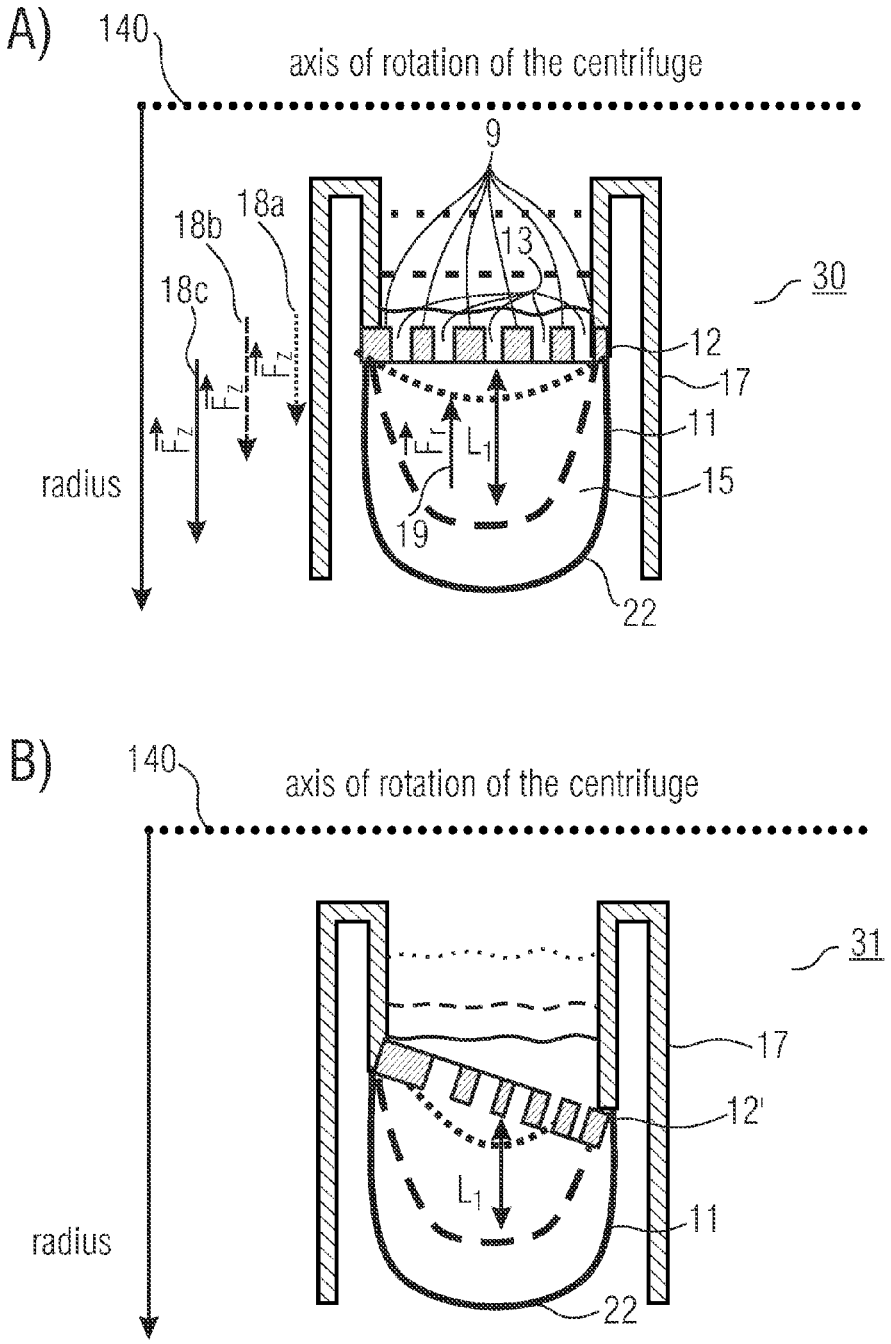
FIGS. 3*a* and 3*b* are schematic representations of further embodiments according to the present invention.

FIG. 3, upper depicts a mixer 30 for insertion into a rotor of a centrifuge according to an embodiment of the present invention. The mixer 30 differs from the mixer 20 that is depicted in FIGS. 2*a* and 2*b* in that the wall section of the mixing trough 11, whose distance is variable in relation to the obstacle device 12, is configured as an elastic membrane 22. The elastic membrane 22 thus constitutes the restoring means as well. Therefore, spring 16 for generating the restoring force that counteracts the centrifugal force has thus been omitted in mixer 30. The obstacle device 12 therein can be disposed on a non-elastic part of the mixing trough 11 or on the housing 17 (as shown in FIG. 3, upper). The elastic membrane 22 therein is able to expand radially to the outside, based on the centrifugal force that is generated by the rotation of the rotor around the axis of rotation 140, such that the distance of the elastic membrane 22 in relation to the obstacle device 12 changes. FIG. 3, upper shows, as indicated by a dotted line, the elastic membrane 22 in a first state at a low angular velocity. In addition, as indicated by a perforated line, FIG. 3, upper indicates the elastic membrane 22 in a second state at a higher angular velocity of the rotor that is in contrast to the first state. In addition, as indicated by a solid line, FIG. 3, upper depicts the elastic membrane 22 in a third state at an even higher angular velocity of the rotor in comparison to the second state. Moreover, also shown by way of a dotted line, a perforated line and a solid line is a liquid level of a liquid 15 that is present in the mixing trough 11 as a function of the expansion of the elastic membrane 22, and thereby as a function of the angular velocity of the rotor. A dotted arrow 18*a* therein indicates an amount of the centrifugal force $F_z$ for the angular velocity in the first state; a perforated arrow 18*b* therein indicates an amount of the centrifugal force $F_z$ for the angular velocity of the rotor in the second state; and a solid arrow 18*c* therein indicates the amount of centrifugal force $F_z$ for an angular velocity in the third state. FIG. 3 above demonstrates that, in the first state, the amount of the centrifugal force $F_z$ is smaller than an amount of the restoring force $F_r$ (represented by an arrow 19).

In the second state (indicated by a perforated line), the amount of the centrifugal force $F_z$ is greater than the amount of the restoring force $F_r$ in the first state, whereby the elastic membrane 22 expands away from the obstacle device 12 and the liquid 15 therein flows through the passage openings 13 of the obstacle device 12. The liquid 15 therein circumflows the obstacles (between the passage openings 13) of the obstacle device 12, which results in a blending action.

In the third state (represented by the solid line), the angular speed of the rotor is further increased, whereby the amount of the centrifugal force $F_z$ is greater than in the second state, thus causing the elastic membrane 22 to stretch further and further increasing the distance $L_1$ between the elastic membrane 22 and the obstacle device 12.

When the angular velocity of the rotor is lowered again, the elastic membrane 22 returns, due to the restoring force $F_r$ that is generated by the same (meaning it retracts toward the obstacle device 12), whereby the liquid 15 repeatedly flows through the passage opening 13 of the obstacle device 12 and repeatedly flows around the obstacles of the obstacle device 12.

In other words, in a state in which the centrifugal force $F_z$ is greater than the restoring force $F_r$, the liquid 15 presses the elastic membrane 22 radially toward the outside and flows during this motion through the passage openings 13 of the obstacle device 12 in a first direction, whereby it circumflows the obstacles of the obstacle device 12 (in the first direction). In a state, when the restoring force $F_r$ is greater than the centrifugal force $F_z$, the elastic membrane 22, on the other hand, presses the liquid 15 in a second direction through the passage openings 13 of the obstacle device 12 such that the liquid flows around the obstacles of the obstacle device 12 (in the second direction).

FIG. 3, lower depicts a mixer 31 according to a further embodiment of the present invention. Mixer 31 differs from the mixer 30 as shown in FIG. 3, upper in that is includes an obstacle device 12' that is at an incline. Further, the passage openings 13 of the obstacle device 12' have varying cross-sections of the openings; in other words, the distances between the obstacles of the obstacle device 12' vary along a direction of expansion of the obstacle device 12'. The inclined obstacle device 12' was explained previously in the context of FIGS. 2*a*, lower and 2*b*, lower. A repetition of said description has, therefore, been omitted.

An elasticity of the elastic membrane 22 of the mixing trough 11 of mixer 30 and mixer 31 is greater than an elasticity of the wall section 14 of the mixing trough 11 of mixer 20 and mixer 21. For example, the wall section 14 of the mixing trough 11 can be constructed of a hard plastic material. The elastic membrane 22, on the other hand, can, for example, be constituted of a soft plastic material such as, for example, an elastomer. The spring 16 of mixers 20 and 21, for example, can be made of the same elastic material as the elastic membrane 22 of the mixers 30, 31. An elasticity coefficient or a spring force coefficient of the spring 16 and the elastic membrane 22 can be equal, for example, such that a restoring force generated by the spring 16 is identical to a restoring force that is generated by the elastic membrane 22.

According to some embodiments, the elastic membrane 22 can be configured such that it bursts open in response to a given angular velocity of the rotor in order to thereby release the liquid 15 that is present in the mixing trough 11. An amount of an angular velocity that is needed for bursting open the elastic membrane 22 can therein be greater than amounts of angular velocities that are used for mixing the liquid 15. In relation to FIG. 3, upper, the angular velocity that is needed for bursting open of the elastic membrane 22 can be greater than the amount of the angular velocity of the rotor in the third state, as represented by the solid line. In particular, between the amount of angular velocity needed for bursting open the elastic membrane 22 and an amount of angular velocity for maximum mixing can include a safety gap of 10%, for example.

Figure 4:
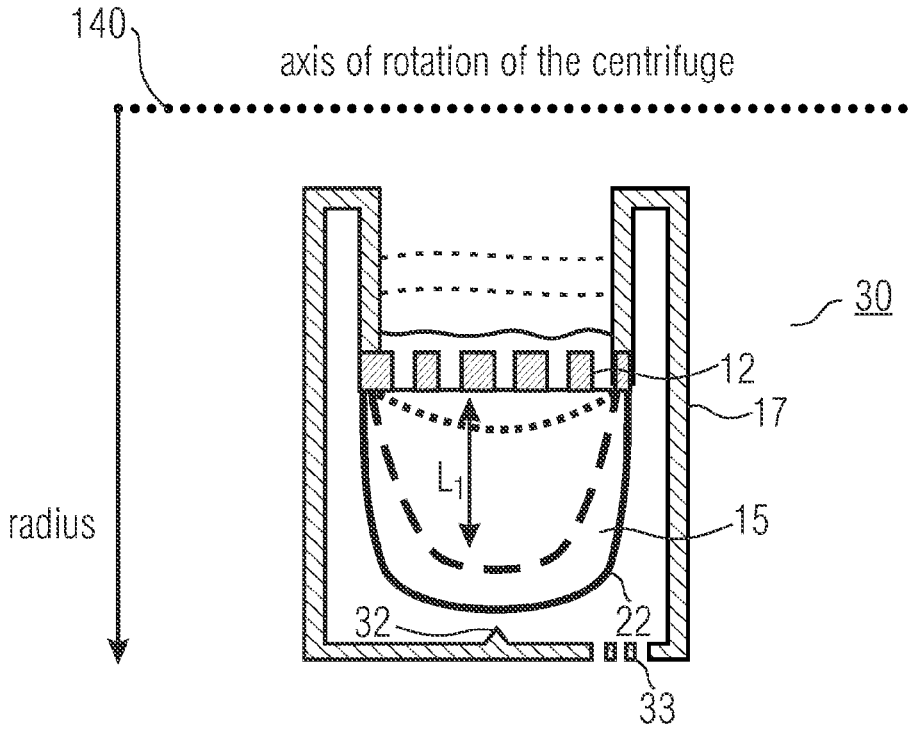
FIG. 4 is a schematic representation of a further embodiment according to the present invention.

FIG. 4 depicts the mixer 30 from FIG. 3 upper, wherein the mixer 30 as shown in FIG. 4 further includes a piercer 32, which, upon rotation of the rotor, is disposed radially further outside than the elastic membrane 22. The piercer therein is configured such as to perforate the elastic membrane 22 at a given angular velocity, whereby the liquid 15 that is present in the mixing trough 11 is released. For example, the elastic membrane 22 can stretch, for example, to a point when the piercer 32 is inserted into it, thereby perforating the elastic membrane 22. An amount of angular velocity that may be used for inserting the piercer 32 can be greater therein than an amount of angular velocity for maximum mixing. Consequently, the amount of the angular velocity needed for the insertion of the piercer 32 can be greater than the amount of the angular velocity in the third state of the mixer 30 as indicated by the solid lines in FIGS. 3 and 4.

The liquid 15 that is released upon a bursting or perforation of the membrane 22 can be present, after having been released, for example, inside the housing 17 of the mixer 30; or, traversing several or one passage openings 33 of the mixer 30, the liquid can leave the mixer 30, for example, at a floor of housing 17 such as, for example, in order to flow into a cavity of a body arranged downstream.

According to some embodiments, a mixer according to an embodiment of the present invention can include sedimentation cavities such as, for example, in a mixing trough. Correspondingly, before a release of the liquid 15 from the mixer, it is possible, for example, that solid materials, bacteria of liquids of higher densities are precipitated inside the mixer; it is envisioned that these components remain inside the mixer (for example, in the mixing trough) after the liquid 15 has been released.

Figure 5:
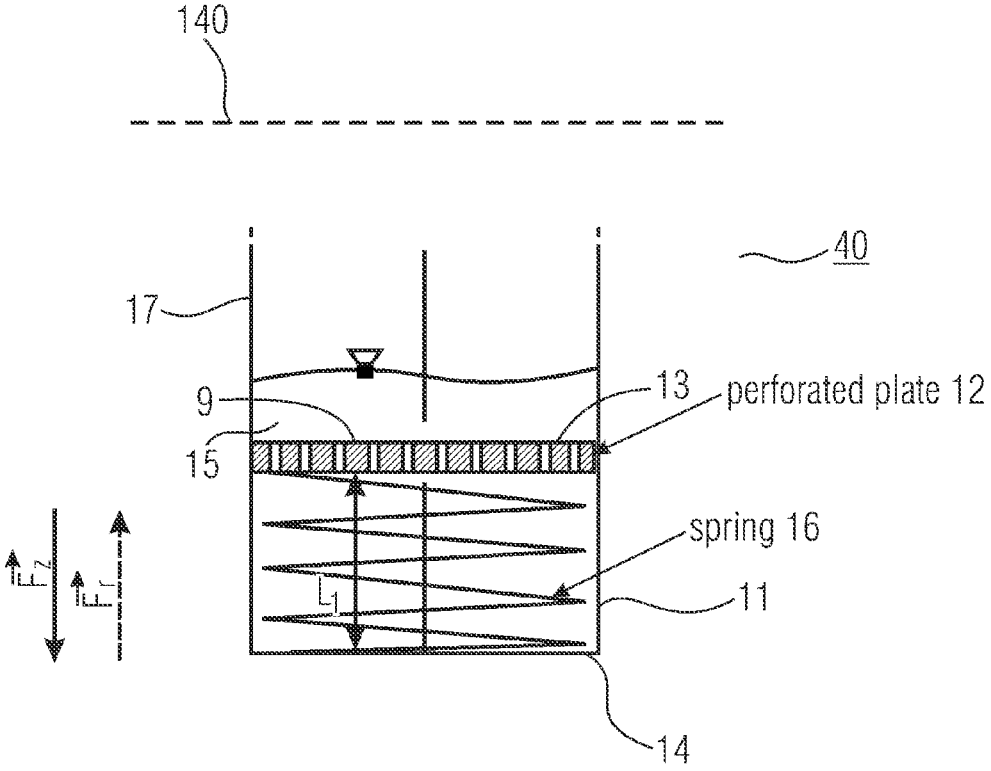
FIG. 5 is a schematic representation of a further embodiment according to the present invention.

FIG. 5 shows a mixer 40 according to a further embodiment of the present invention. The mixer 40 that is depicted in FIG. 5 differs from the mixer 20 as shown FIG. 2*a*, upper in that here the mixing trough 11 is not movably supported; instead, the obstacle device 12 (configured herein as a perforated plate 12) is movably supported inside the mixing trough 11. The mixing trough 11 is locked in place on the housing 17 of the mixer 40. Therefore, the obstacle device 12 is freely movable inside the mixing trough 11 and movably supported in relation to the housing 17 of the mixer 40. Moreover, the spring 16 is disposed between the wall section 14 and the obstacle device 12, with a variable distance $L_1$ there-between the wall section 14 and the obstacle device 12. Based on a change of the angular velocity of the rotor, the mixer 40 moves, contrary to the mixer 20, up and down the obstacle device 12 within the mixing trough 11 (from radially inside to radially outside and back), migrating therein through the liquid 15. In other words, in the mixer 40 as shown in FIG. 5, the liquid 15 is not moved from radially more inside to radially more outside, instead, however, it is the obstacle device 12 (the perforated plate 12) that is moved. By moving the obstacle device 12, the liquid 15 flows through passage openings 13 in the obstacle device 12. In other words, the liquid 15 flows around obstacles 9 (in FIG. 5 shown as cross-hatched) of the obstacle device 12, thereby achieving a mixing effect.

Figure 6:
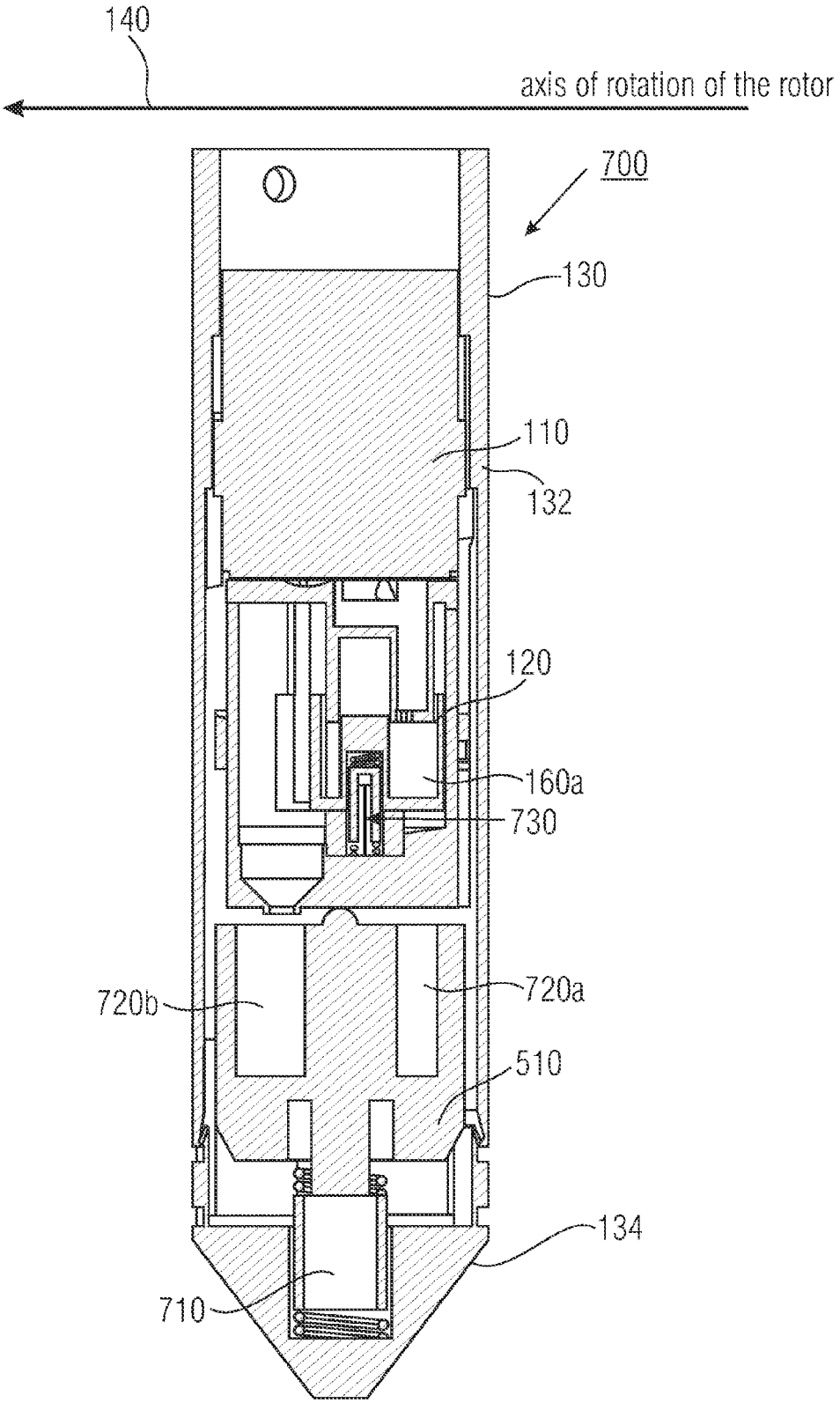
FIG. 6 is a schematic representation of an device for incorporation in a rotor of a centrifuge with a mixer according to an embodiment of the present invention.

FIG. 6 shows a sectional view of an device 700 for insertion into a rotor of a centrifuge. The device 700 therein includes a mixer 730 according to an embodiment of the present invention inside a cavity 160*a* of a second body 120. The mixer 730 can subsequently also be referred to as a mixing device 730. The device 700 includes three bodies 110, 120, 510 that are disposed in a stacking direction inside a housing 130, wherein, upon a rotation of the device 700 around an axis of rotation 140, a first body 110 is disposed radially furthest to the inside and a third body 510 radially furthest to the outside. The second body 120 disposed between the first body 110 and the third body 510. The device 700 is configured such that, responding to a rotation of the rotor, the second body 120 is able to twist in relation to a first body 110 and the third body 510. This allows for coupling different cavities of the first body 110 with the cavity 160*a* of the second body 120 in different phases, based on a rotation of the rotor. The first body 110 therein includes eight cavities, such as reagent pre-storage chambers, for example.

As mentioned previously, the second body 120 has inside cavity 160*a* thereof the mixing device 730 (mixer 730) that is configured to blend, responding to a rotation of a rotor, at least two fluids located inside the cavity 160*a*. In addition, the third body 510 includes a first cavity 720 and a second cavity 720*b*. The first cavity 720*a* of the third body 510 can, for example, be an eluate collecting tank or an eluate chamber, and the second cavity 720*b* of the third body 510 can be, for example a so-called waste (waste fluids) collecting tank or a waste chamber.

Furthermore, the housing 130 includes two housing parts 132, 134 that can be separated from each other, whereby, if these two housing parts 132, 134 are separated, at least one of the bodies of the device 700 (for example, the third body 510) can be removed from the device 700. According to further embodiments, the housing 130 can include a plurality of housing parts 132, 134. The individual housing parts 132, 134 can, for example, be plugged into each other by means of springs and grooves or connected to each other by means of screwed connections. A first housing part 132 of the two housing parts 132, 134 of housing 130 can also be designated as a first sleeve 132, and a second housing part 134 of the two housing parts of the housing 130 can be also be designated a second sleeve 134. As shown in FIG. 6, to close the housing 130, the second sleeve 134 is plugged onto the first sleeve 132.

The three bodies can also be designated as revolvers, respectively. Correspondingly, the first body 110 can be referred to as a first revolver 110, the second body 120 as a second revolver 120 and the third body 510 as a third revolver 510.

The first revolver 110 includes a pre-storing means for reagents, as described previously.

As described previously, the second revolver 120 includes the mixing device 730. The third revolver 510, as described previously, includes an eluate chamber 720*a* and a waste chamber 720*b*.

In addition, the device 700 includes a spring 710 for the lateral movement of the three revolvers 110, 120, 510. The spring 710 serves for generating the restoring force that counteracts the centrifugal force, generated by the rotation of the rotor, in order to allow for a switching process (for example, a twisting action of the second revolver 120 in relation to the two other revolvers). The spring 710, for example, can be comparable to the restoring spring on a ball point pen; a twisting action of the second revolver 120 in relation to the two other revolvers 110 and 510 can thus be based on the mechanical action of a ball-point pen.

The device 700 as depicted in FIG. 6 having three revolvers 110, 120, 510 can be used, for example, for DNA extraction. As described previously, a mechanical action such as on a ball point pen is able to translate the centrifugation protocol into a gradual twisting action of the second revolver 120 in relation to the first revolver 110 and in relation to the third revolver 510.

The spring 710 below the third revolver 510 regulates the spacing in relation to the sleeve and/or the housing 130 that includes the housing parts 132, 134 (or consists of the same). The three revolvers 110, 120, 510 are moved by the interaction of spring 710 with the centrifugal force. This powers the ball point pen mechanism of the device 700, and the second revolver 120 is twisted in relation to the two other revolvers 110, 510.

The spring 710 can be configured as a compression spring or a tension spring. Furthermore, according to further embodiments, the spring 710 can also be configured as a restoring means that generates a restoring force acting on at least one body of the device 700. In particular, expedient restoring means are, for example, elastomer materials (rubber band), metal springs, thermoplastic or thermosetting materials. According to further embodiments, the restoring means can be manufactured as a component of a body (for example, as a component of a third body 510). Manufacturing methods of this kind are known in the art from the packaging industry and are used, for example, in injection molding processes for the manufacture of tablet tube lids. Thus, there is a reduction in the number of parts as well as a lesser complex assembly.

Figure 7A:
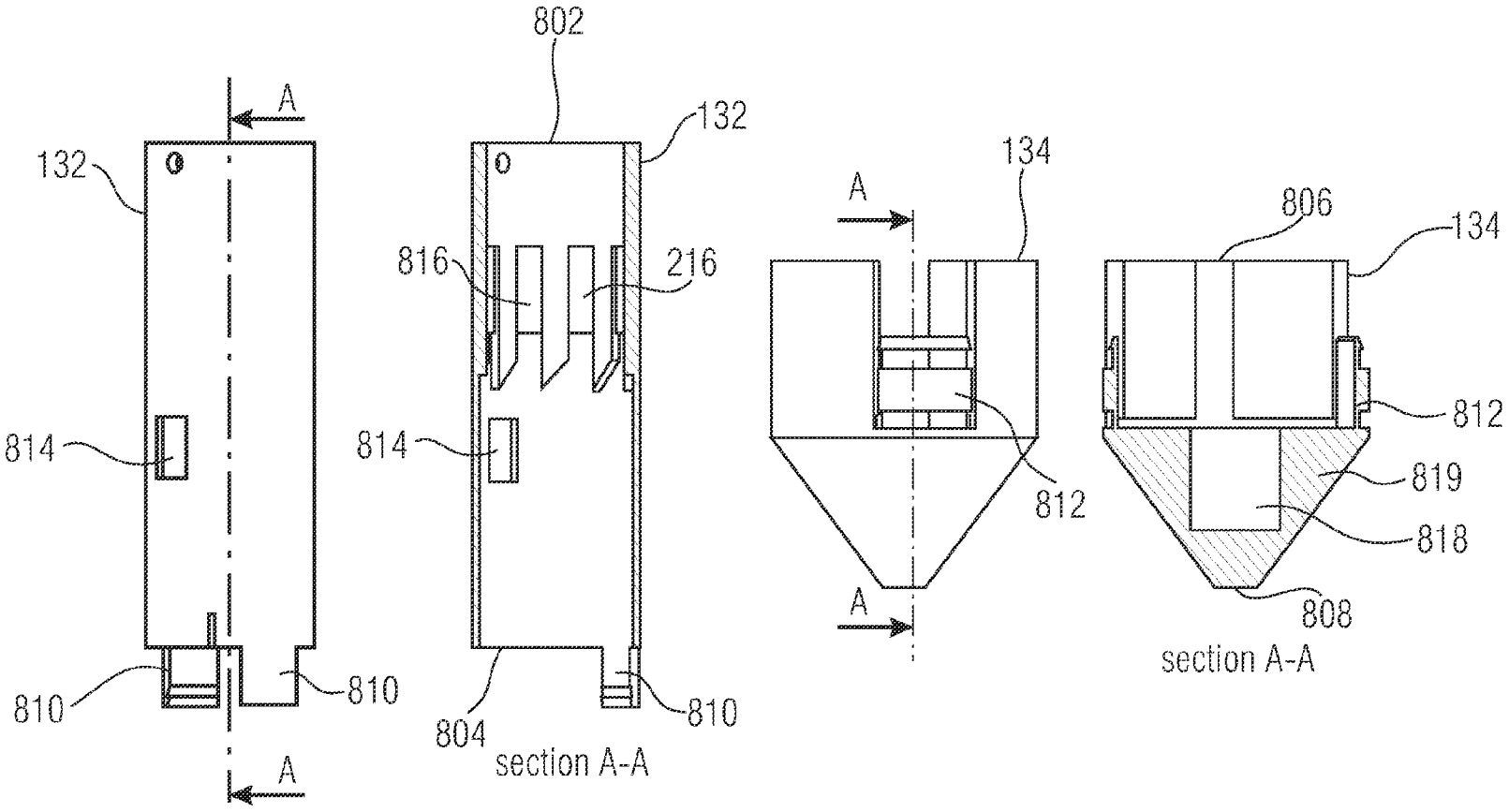
FIGS. 7*a* to 7*d* are schematic representations of the individual components of the device from FIG. 6.

FIG. 7*a* depicts on the left the first housing part 132 of the housing 130, seen in a lateral view and a sectional view along a sectional axis A-A. Furthermore, FIG. 7*a* shows on the right the second housing part 134 of the housing 130, seen in a side view and a sectional view along a sectional axis A-A. The second housing part 134 constitutes a bottom end of device 700, meaning, upon rotation of the device 700, the second housing part 134 is radially furthest to the outside, particularly, it is radially further outside than the first housing part 132. The first housing part 132 has a cylindrical shape and a circular cross-section. On a base side 804 of the first housing part 132, the first housing part 132 includes two hooks 810 that are arranged opposite each other. The two hooks 810, which are arranged opposite each other, are configured such that they can be received in two hook recesses 812, which are arranged opposite each other on the second housing 134. The two hooks 810 protrude the side 804 of the first housing part 132.

In addition, the housing part 132 can have an observation window 814 (for example, of a transparent plastic material) that constitutes, for example, in combination with a display on the second body 120, a phase display to indicate a given phase that the device 700 is in at the time the reading is taken.

Moreover, the first housing part 132 can have on its inner side a plurality of guide grooves 816 that extent at least in a partial area of the inside region of the first housing part 132 in a direction that is orthogonal in relation to a cover side 802 of the first housing part 132. The guide grooves 816 can have beveled ends at the ends thereof that are directed toward the base side 804, respectively. The inside region of the first housing part 132 can, for example, be accessible from the base side 804 of the first housing part 132 such as, for example, to insert the three revolvers 110, 120, 510 into the first housing part 132. Furthermore, the first housing part 132 can be open or closed at the location of its cover side 802 and can include, for example, a lid at the cover side 802.

The second housing part 134 has the same circular cross-section on a cover side 806 as the first housing part 132 has on the base side 804 thereof. The hook recesses 812 are disposed, adjusted to the hooks 810 of the first housing part 132, offset to the rear in relation to the cover side 806 on the second housing part 134. In a region where the hook recesses 812 no longer extend, the circular cross-section of the second housing part 134 can be tapered in relation to the base side 808 of the second housing part 134, meaning the housing part 134 can be configured having the shape of a frustrum of a cone at an end thereof that is opposite in relation to the cover side 806. Within the end that is shaped like the frustum of a cone, the housing part 134 can include a recess 818 for the spring 710. An inside region of the second housing part 134 can be accessible from the cover side 806 of the second housing part 134, for example, for receiving a third 510 and/or for removing the same from the housing 130.

A length ranging from the cover side 802 to the base side 804 of the first housing part 132 can be larger than a length ranging from the cover side 806 to the base side 808 of the second housing part 134.

In terms of their external dimensions, the housing 130, and thereby the two housing parts 132, 134, can correspond to a standard laboratory centrifuge cavity having a volume of, for example, 500 ml, 250 ml, 50 ml, 18 ml to 12 ml, 15 ml, 2 ml, 1.5 ml or 0.5 ml.

Figure 7B:
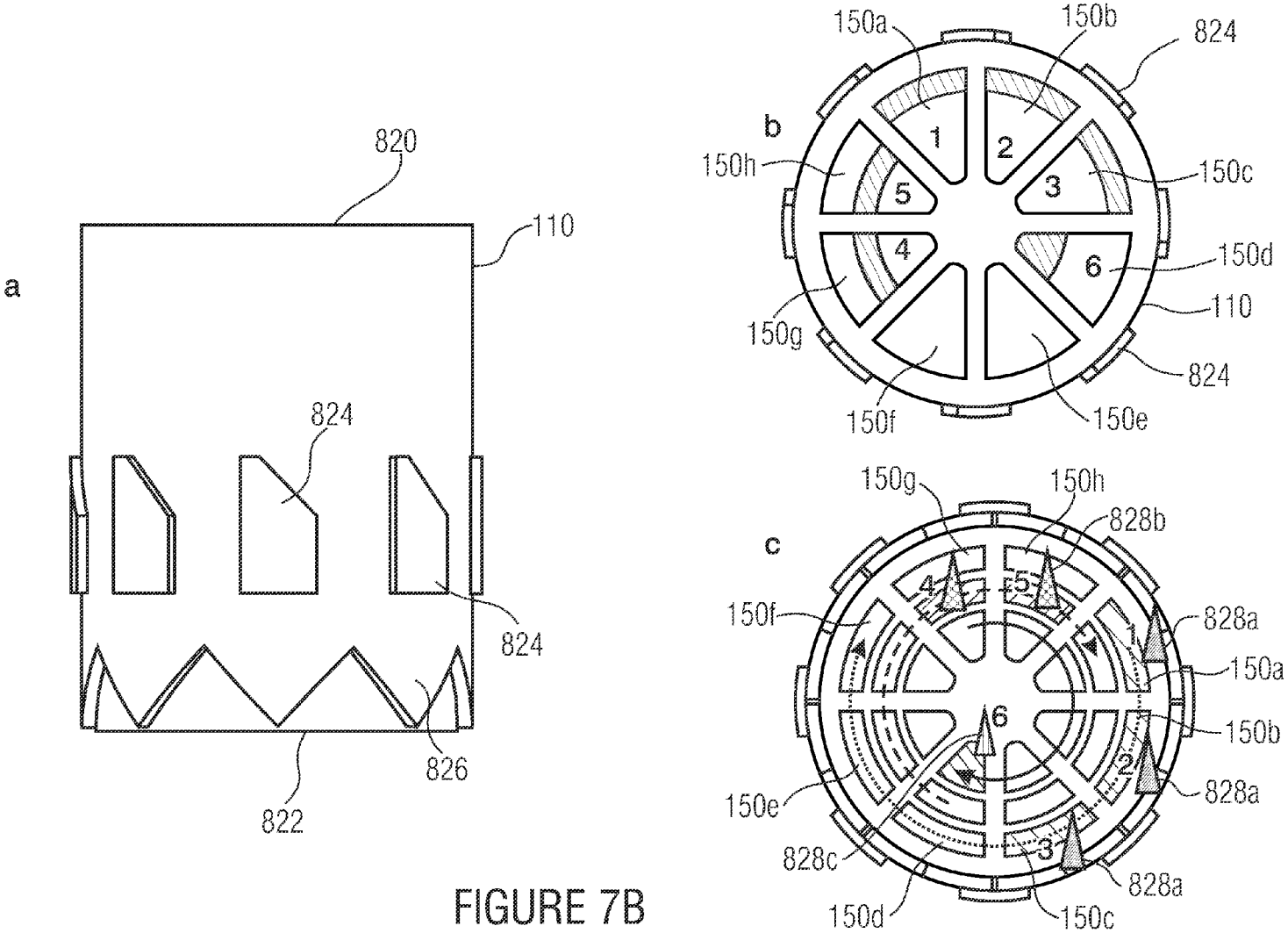

FIG. 7*b* depicts schematic representations of the first body 110 of the device 700 according to FIG. 6. FIG. 7*b-a* shows the first body 110 and/or the first revolver 110 in a side view. As mentioned previously, the first body 110 is a cylindrical body 110 having a cover side 820 and an opposite base side 822. On the outer side thereof, the first body 110 has a plurality of the guide springs 824. The number of guide springs 824 can be adjusted, for example, to the number of guide grooves 816 on the first housing part 132 (meaning housing 130). The guide springs 824 of the first body 110 are configured such that they engage with the guide grooves of housing part 132. The guide springs 824 can be configured such (in connection with the guide grooves 816 of the first housing part 132) as to prevent any twisting of the first body 110 with regard to the other bodies 120, 510 (for example, during the transition from a first phase to a second phase). The guide springs 824 of the first body 110 can be beveled at the ends that are directed toward the cover side 820, for example, in order to allow for a easier insertion of the first body 110 in the housing 130 (meaning in the second housing part 134). The beveled ends of the guide springs 824 preclude (or at least almost preclude) any blocking of the guide springs 824 with the guide grooves 816 of the first housing 132 during the insertion of the first body 110.

Moreover, at its base side 822, the first body 110 can include a plurality of profile teeth 826 that are disposed continuously around the first body 110. Any number of profile teeth 826 can, for example, be adjusted to any number of process steps that are to be implemented in the apparatus. Correspondingly, a number of profile teeth, as used in different devices that are suitable for various (bio) chemical processes, can vary. Analogously, the number of guide springs 824 and guide grooves 816 can vary as well. In the example as shown in FIGS. 7*a* and 7*b*, the first housing part 132 has eight guide grooves 816. Furthermore, the first body 110 has eight guide springs 824 and eight profile teeth 826.

The profile teeth 826, for example, can be configured such as to allow for a guiding action of the second body 120 and/or the second revolver 120. In other words, FIG. 7*b-a* demonstrates by way of a side view of a first revolver 110 structures for the ball point mechanism having grooves with guide springs 824 for achieving the guiding action in the column (in the first housing part 132) and recesses (profile teeth 826) for guiding the second revolver 120.

FIG. 7*b-b* depicts a top view of the first revolver 110 having a plurality of cavities for the pre-storage of reagents. In the example shown here, the first revolver 110 has eight cavities. For example, the eight cavities are suitable for pre-storing eight different reagents for processing.

Figure 7C:
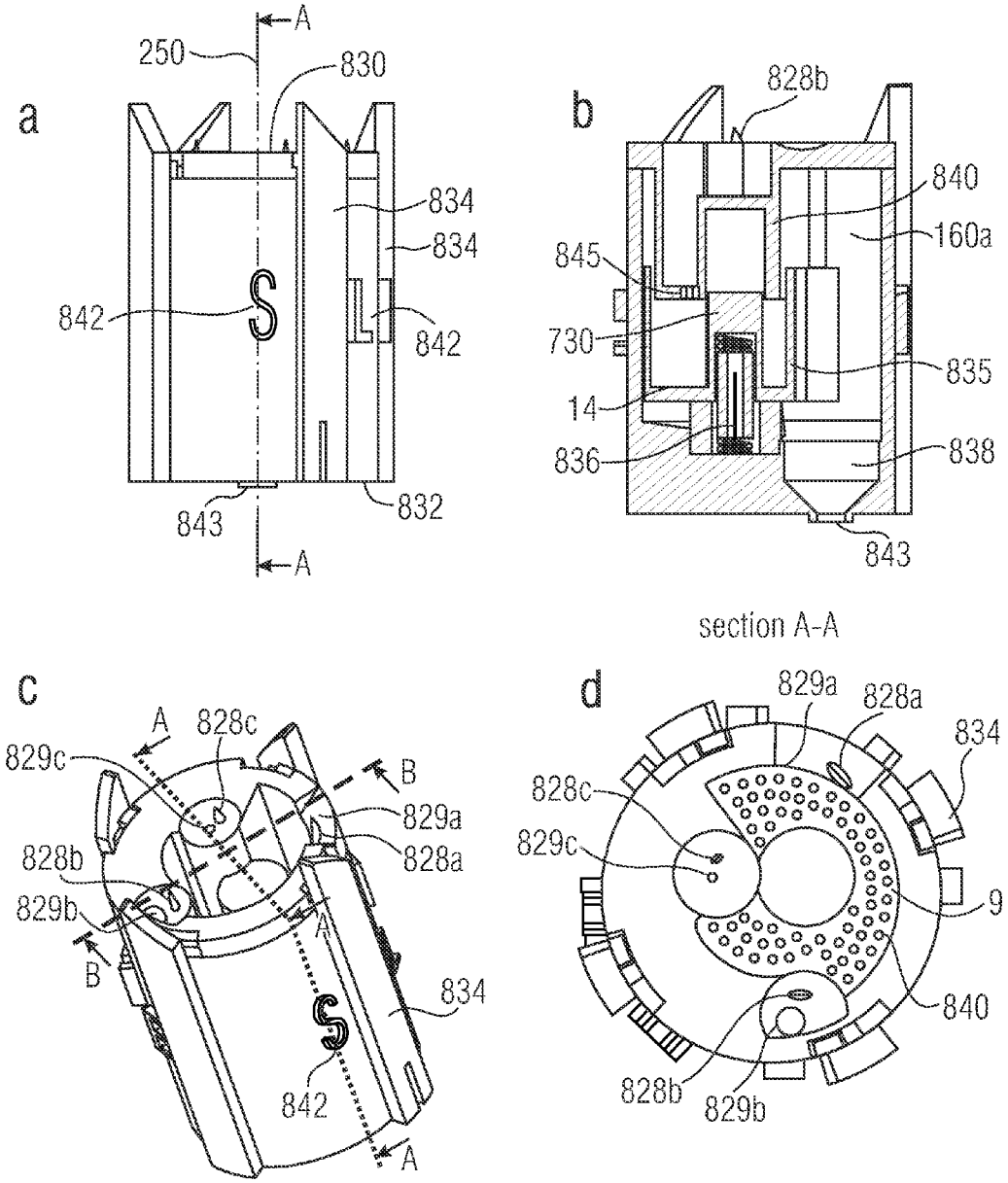

FIG. 7*b-c* demonstrates a view from the bottom perspective of the first revolver 110 with the paths of three piercers that are disposed, for example, on the second revolver 120 for the purpose of opening locking means to the cavities of the first revolver 110. The three piercers perforate, respectively, the chambers (the cavities) with the pre-stored reagents. 7*b-c* represents the respective paths that the individual piercers traverse while the second body 120 is twisted in relation to the first body 110. One path of a first piercer 828*a* is represented by a dotted arrow. One path of a second piercer 828*b* is represented by a perforated arrow. Finally, one path of a third piercer 828*c* is represented by a solid arrow. The individual numbers in the respective cavities indicate both in FIG. 7*b-b* as well as in FIG. 7*b-c* in which phase, meaning in which order, the individual cavities and/or their locking means are perforated by one of the piercers. Correspondingly, for example, a first cavity 150*a* of the first body 110 is perforated in a first phase by the first piercer 828*a*. Any liquid and/or process means that is located inside the first cavity 150*a* of the first body 110 can then flow into a cavity of the second body 120. In a second phase, in which the second body 120 is twisted by one step in relation to the first body 110 (in contrast to the first phase), a second cavity 150*b* of the first body 110 is perforated by the first piercer 828*a*, whereby any liquid present in the second cavity 150*b* of the first body 110 can flow into a cavity of the second body 120 (for example, in the same cavity into which the liquid from the first cavity 150*a* of the first 110 flowed previously). In a third phase, a third cavity 150*c* is perforated by the first piercer 828*a* such that any liquid that is present inside the third cavity 150*c* can flow into a cavity of the second body 120. The first piercer 828*a* therein can thus be connected with the cavity of the second body 120 such that liquids of cavities that were perforated by the first piercer 828*a* flow altogether into one and the same cavity in the second body 120. In a fourth phase, the second piercer 828*b* perforates a seventh cavity 150*g* of the first body 110 such that any liquid that is present in the seventh cavity 150*g* flows into a cavity of the second body 120. In a fifth phase, the second piercer 828*b* perforates an eighth cavity 150*h* of the first body 110 allowing any liquid that is present in the eighth cavity 828*a* to flow into a cavity of the second body 120 (for example, the same cavity in which the liquid from the seventh cavity 150*g* has flown). The second piercer 828*b* therein can be configured such, analogously in relation to the first piercer 828*a*, that liquids from cavities that are perforated by the second piercer 828*b* flow into a joint cavity in the second cavity or at least take a common fluid path into the second body 120. In a sixth phase, the third piercer 828*c* perforates the fourth cavity 150*d* thereby allowing any liquid that is present inside the fourth cavity 150*d* to flow into a cavity of the second body 120. Further reagents can be pre-stored in a fifth cavity 150*e* and a sixth cavity 150*f*; or no reagents are pre-stored.

To prevent that a piercer perforates a cavity before the liquid is needed by the respective cavity, it is possible to dispose the piercers as offset on the second body 120 and to provide that the piercers can perforate the closing means of the respective cavities only at certain locations, which are identified by cross-hatched markings in FIGS. 7*b-b* and 7*b-cd*. Moreover, it is also possible for the individual piercers 828*a*, 828*b*, 828*c* to be extended from the second body 120, exactly in a phase when they are needed, and retracted into the body 120 in another phase, when they are not needed. This can be initiated, for example, by the centrifugation protocol.

Figure 7D:
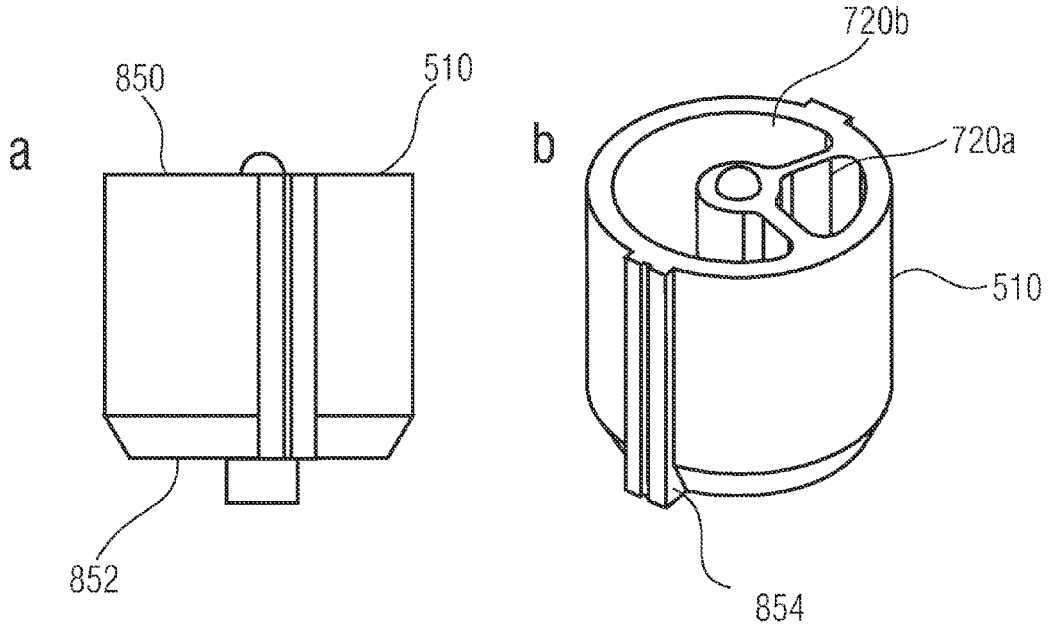

FIG. 7*c* depicts a second body 120 (the second revolver 120) from different perspectives. FIG. 7*c-a* shows the second body 120 in a side view. FIG. 7*c-b* shows the second body in a sectional representation along a sectional axis A-A. FIG. 7*c-c* depicts the second body 120 in an isometric view. FIG. 7*c-d* shows the second body 120 by way of a top view. FIG. 7*c-e* shows the second body 120 in a further sectional view along a sectional axis B-B.

The second body 120 constitutes a housing of the mixing device 730 or the mixer 730. A mixing trough 835 of the mixer 730 and an obstacle device 840 (here represented as a perforated pan 840) of the mixer 730 are disposed in the cavity 160*a* of the cylinder-shaped housing (of the second body 120).

The second body 120 is a cylindrical body with a cover side 830 and a base side 832 disposed opposite thereto. The second body 120 includes on its cover side 830, which can also be referred to as a lid, the three piercers 828*a*,828*b*, 828*c*. The three piercers have different spacings in relation to the axis of rotation 250 of the body 120. The first piercer 828*a* is disposed furthest away from the axis of rotation 250, and the third piercer 828*c* is disposed the least far away from the axis of rotation. The second body 120 includes, in addition, a plurality of guide springs 834 that are disposed on an outer side of a second body 120. In the embodiment as shown in FIG. 7*c*, the second body 120 has four guide springs 834. The guide springs 834 protrude the cover side 830 of the second body 120 having beveled ends in their end region, respectively, where they protrude the cover side 830. The guide springs are configured such that, during a transition from one phase of the device 700 to the next phase (for example, from the first phase to the second phase), they alternately engage with the profile teeth 826 of the first body 110 and the guide grooves 816 of the housing 130. Any number of guide springs 834 can depend on the number of the process steps that are to be implemented in the context of a process for which device 700 is provided.

A mentioned previously, the second body 120 includes a mixing device 730 or, in other words, the second body 120 constitutes a housing of the mixing device 730. The mixing device 730 therein is configured for blending at least two different fluids or liquids within the cavity 160*a* of the second body 120. Therefore, in the following below, cavity 160*a* of the second body 120 can also be referred to as a mixing chamber 160*a*. The mixing device 730 includes within the mixing chamber 160*a* a first mixing spring 836 (comparable to the spring 16 of mixer 20 according to FIG. 2*a*, upper) for the mixing action. Furthermore, the mixing device 730 includes the perforated trough 840 that is locked in place inside the mixing chamber 160*a* on the second body 120 (comparable with the obstacle device 12 of the mixer 20 according to FIG. 2*a*, upper) with obstacles 9 and openings 845 (comparable to the passage openings 13 of the mixer 20 according to FIG. 2*a*, upper). The perforated trough 840 or the obstacle device 840 can also be referred to as the perforated plate 840.

The openings 845 of the perforated trough 840 are disposed such in the perforated trough 840 that, upon receiving the device 700 in a rotor of a centrifuge and a rotation of the rotor, the openings 845 are disposed radially the furthest to the outside in relation to the perforated trough 840. The perforated trough 840 can be open toward the cover side 830 of the second body 120, whereby liquid from a cavity of the first body 110 can flow into the cavity 160*a* of the second body 120 and thereby into the perforated trough 840.

In addition, the mixing device 730 includes, inside the mixing chamber 160*a*, a mixing trough 835 (comparable to the mixing trough 11 of the mixer 20 according to FIG. 2*a*) or a mixing bowl 835. The mixing trough 835 is movably supported in relation to the perforated trough 840 within the mixing chamber 160*a*. The mixing chamber 835 is disposed such that, upon a rotation of the device 700, the mixing trough 835 (or at least a wall section 14 of the mixing trough 835) is disposed radially further outside than the perforated trough 840.

A liquid that is located inside the perforated trough 840 can flow, due to the centrifugal force that is generated by the rotation, through the openings 845 of the perforated trough 840 and into the mixing trough 835. The perforated trough 840 and the mixing trough 835 therein are configured such that, upon a motion by the mixing trough 835, the perforated trough 840 can be retracted into the mixing trough 835. The mixing trough 835 has thus a larger cross-section than the perforated trough 840 for receiving the perforated trough 840 therein, when the mixing trough 835 moves. The mixing trough 835 has an elevation 846 for receiving the first mixing spring 836. In addition, the perforated trough 840 has an elevation 848 that is adjusted to the elevation 846 of the mixing trough 835, whereby the perforated trough 840 can be accommodated by the mixing trough 835, when the mixing trough 835 moves toward the perforated plate 840.

The first mixing spring 836 therein is disposed such between the mixing trough 835 and the second body 120 (the housing of the mixing device 730) that it exercises a restoring force on the mixing trough 835, counteracting the centrifugal force.

Furthermore, the mixing trough 835 can include one hole 841 or multiple holes 841 with a closing means such as, for example, a lid film 847. A hole 841 can also be referred to as a passage opening 841 of the mixing trough 835.

The hole 841 of mixing trough 835 is disposed therein on the mixing trough 835 in such a way that, upon a rotation of the rotor, the hole 841 is disposed radially furthest to the outside in relation to the mixing trough 835. A piercer 833 can be disposed on the second body 120. The piercer 833 therein can be disposed on the second body 120 in such a way as to perforate, responding to a given angular velocity of the rotor, the lid film 847 of the hole 841. The piercer 833 therein constitutes, in connection with the hole 841 and the lid film 847, a valve of the mixing trough 835 and also of the mixing chamber 160*a* of the second body 120. The mixing device 730 can include, furthermore, a second mixing spring 837 inside the mixing chamber 160*a*. The second mixing spring 837, like the first mixing spring 836, can be disposed between the mixing trough 835 and the second body 120, wherein a spring constant of the second mixing spring 837 can be greater than a spring constant of the first mixing spring 836. This means that a restoring force that is generated by the first mixing spring 836 is smaller than a restoring force that is generated by the second mixing spring 837.

In other words, in the wall section 14, the mixing trough 835 can include at least one passage opening 841 with a lid film 847. In addition, the mixing device 730 can include a piercer 833 configured such that, responding to a given angular velocity, the same perforates the lid film 847. An angular velocity of the rotor that is needed for the perforation of the lid film 847 therein is greater than an amount of an angular velocity that may be used for blending the liquids that are present in the mixing trough 835.

For example, a maximum mixing angular velocity of the rotor can be referred to as the first angular velocity of the rotors; and a minimum mixing angular velocity at which, for example, the distance $L_1$ between the perforated trough 845 and the wall section 14 of the mixing trough 835 is minimal is, can be referred to as the second angular velocity. A third angular velocity of the rotor that may be used for the perforating action of the lid film 847 by means of the piercer 833 is greater therein than the first angular velocity and the second angular velocity of the rotor. With the third angular velocity of the rotor, the distance $L_1$ between the wall section 14 and the perforated trough 845 is still greater than with the first angular velocity of the rotor.

While it is possible to achieve the first and the second angular velocity of the rotor multiple times during a mixing process such as, for example, in order to generate multiple movements of the mixing trough 835 in the cavity 160*a*, typically, the third angular velocity of the rotor is achieved only once because, after the opening the lid film 847, the liquid that is present in the mixing trough 835 exits the mixing trough 835 and no further mixing is possible inside the mixing trough 835.

In addition, the second body 120 can include a drain nose 843 on its base side 832 thereof.

Depending on the frequency of rotation or an angular velocity of a rotor of a centrifuge, the first mixing spring 836 moves the mixing trough 835 within the cavity 160*a* (of the mixing chamber 160*a*) up and down, whereby any liquid that is located inside the mixing chamber 160*a* is blended with another liquid that is present in the mixing chamber 160*a*. In other words, the mixing trough 836 is moved due to the alternating centrifugal force with any change of the angular velocity of the rotor and the restoring force that counteracts the centrifugal force of the first mixing spring 836. Thus, the mixing trough 835 is moved by the centrifugal force to a point radially further to the outside, and the first mixing spring 836 counteracts this motion. By the alternating frequency of rotation of the centrifuge, the mixing trough 835 moves back and forth. Each motion by the mixing trough 835, any liquid that is present in the mixing trough 835 is transported through the openings 845 of the perforated trough 840. With an expedient design of the perforated trough 840 and the openings 845, this results in a blending action. In other words, with a changeable length of the springs, the liquid flows through the openings 845 of the perforated trough 840, thereby causing a mixing process. This mixing is embodied by means of the interaction between the centrifugal force and the restoring force (generated by the first mixing spring 836). The change in the frequency of rotation of the centrifuge (or in the angular velocity of the rotor of the centrifuge) moves the mixing trough (or mixing bowl) 835 from a location that is radially further to the inside to a location that is radially further to the outside, and vice versa. The liquid that is present in the mixing trough 835 is directed therein through the openings 845 of the perforated trough 840 and circumflows the rims of the openings 845, meaning the obstacles 9 of the perforated trough 840, thus causing a blending action.

The second mixing spring serves for switching the valve (constituted of the hole 841, the lid film 847 and the piercer 833). As mentioned previously, the second mixing spring 837 has a higher spring constant than the first mixing spring 836. A holding force that is generated by the second mixing spring 837 is, therefore, greater than the restoring force generated by the first mixing spring 836. Consequently, the second mixing spring 837 is only compressed at comparatively high frequencies of rotation of the centrifuge, whereby the mixing rough 835 moves radially to the outside to the piercer 833 for the piercer 833 to open the lid film 847 of the hole 841. An angular velocity that is needed for compressing the second mixing spring 837 (for example, the third angular velocity as described previously) of the rotor of the centrifuge can therein, in particular, be greater than the angular velocity that may be used for compressing the first mixing spring 836 (for example, the first angular velocity) of the rotor. In other words, an amount of the holding force generated by the second mixing spring 837 at the first angular velocity and the second angular velocity is greater than amounts of the component of the centrifugal force acting counter to the restoring force. With the third angular velocity, on the other hand, the amount of the holding force is smaller than an amount of the component of the centrifugal force counteracting the restoring force. Correspondingly, with the first angular velocity and the second angular velocity, the lid film 847 is located at a distance relative to the piercer 833, and at the third angular velocity, the piercer 833 is inserted and/or is being inserted into the lid film 847.

In addition, a spring constant of the first mixing spring 836 can be greater than a spring constant of spring 710 that serves for twisting the second body 120 in relation to the other two bodies 110, 510 of the device 700.

After opening the lid film 847 by means of the piercer 833, the liquid that is present in the mixing trough 835 can exit the second revolver 120 via the column 838 (for example, via a silicate column 838) into the mixing chamber 160*a* through the drain nose 843 and flow, for example, into the waste collection container (in the waste chamber) 720*b* or eluate collection container (in the eluate chamber) 720*a* of the third body 510.

The piercers 828*a*, 828*b*, 828*c* can have fluid guides on the cover side 830 of the second body 120 such as, for example, in the form of funnels and subsequent channels or in form of slopes such that they allow for different paths inside the mixing chamber 160*a* that the fluids, whose cavities they perforate, can take.

For example, fluids that were released by the first piercer 828*a* are routed directly by means of the first fluid guide 829*a*, which is configured as a slope, into the perforated trough 840. Fluids that were released by the second piercer 828*b* can be routed, for example, by means of a second fluid guide 829*b*, which is configured as a funnel with a channel leading past the perforated trough 840 and the mixing trough 835 to the column 838 or in a region of the mixing chamber 160*a*, outside the mixing trough 835. For example, the region can be fluidically connected to the column 838, whereby the fluid flows from the region onto the column 838. Fluids that were released by the third piercer 828*c* can also be guided directly over the column 838, for example, by means of a third fluid guide 829*c*, which is also configured as a funnel with a channel leading past the perforated trough 840 and the mixing trough 835. The channel of the third fluid guide 829*c* therein can have a smaller cross-section than the channel of the second fluid guide 829*b*, for example such that a fluid flows slower through the third fluid guide 829*c* than through the second fluid guide 829*b*.

Furthermore, the mixing chamber 160*a* can be tapered by way of a frustum of a cone in a region below the mixing trough 835 (radially further outside than the mixing trough 835), such as, for example, in order to constitute a funnel toward the drain nose for the fluids that are present inside the mixing chamber 160*a*.

According to further embodiments, the valve in the mixing chamber 160*a* can also be configured as a predetermined breaking point or a siphon, for example, for blending several liquids and/or reagents from the first body 110 within the mixing chamber 160*a* and for opening, as part of preset process step, said valve or predetermined breaking point or siphon, thus allowing the blended reagents to exit the mixing chamber 160*a* (for example via the drain nose 843).

According to further embodiments, the lid film 847 in the wall section 14 of the mixing trough 835 can be configured such that it bursts open in response to the third angular velocity, whose amount is greater than the first angular velocity and the amount of the second angular velocity. In this instance, the piercer 833 would no longer be necessary, thus resulting in a simplified manufacture of the mixing device 730.

As described previously, the mixing chamber 160*a* can include at one exit (at the drain spout 843) that is directed toward the base side 832 a (chromatographic) column 838 such as needed, for example, for a DNA extraction for constituting reagents. A blended liquid therein, as described above, can be routed over the column 838 via a valve or a predetermined breaking point or via a siphon. As described above, the mixing chamber 160*a* can include a film 847 or a membrane 847 that can be perforated by a piercer 833 that is located in the second body 120, responding to a given angular velocity of the rotor.

According to further embodiments, the mixing trough 835 can be locked in place in the second body 120 or supported on the second mixing spring 837. The perforated trough 840 therein is able to move upward and downward, based on the changeable angular velocity of the rotor, within the mixing trough 835. The first mixing spring 836 therein can, for example, be disposed between the mixing trough 835 and the perforated trough 840.

According to further embodiments, the second body 120 can include a plurality of cavities and thereby also a plurality of mixing chambers, for example, with separate mixing devices.

According to further embodiments, the second body 120 can have a dial indicator 842 on its outer side that can constitute, for example, in connection with the observation window 814 of the first housing part 132 a phase indicator of the device 700. The dial indicator 842 is easily embodied, for example, using letters and/or numbers that indicate a phase of the device 700.

FIG. 7*d* depicts the third body 510 (the third revolver 510), specifically seen in two different views. FIG. 7*d-a* represents the third body 510 in a side view and FIG. 7*d-b* shows the third body 510 by way of an isometric view. The third body 510 is a cylindrical body having a cover side 850 and a base side 852 located opposite thereto. The third body 510 includes, as described previously in connection FIG. 6, a waste chamber 720*b* and an eluate chamber 720*a* in order to catch the eluate such as, for example, reconcentrated DNA. Moreover, the third body 510 includes guide springs 854 at its outer side such as, for example, for preventing any twisting of the third body 510 when the device 700 transitions from one phase to the next phase.

In addition, the third body 510 can be configured such that it can be removed from the housing 130, for example, in order to further process the liquid that has been collected in the eluate chamber 720*a*.

According to some embodiments, the mixer can also include sedimentation cavities in which bacteria and other solid materials can be precipitated. Said bacteria and solids can have a greater density therein than a liquid mixture, which can be removed from the mixer or the mixing trough for further use. Embodiments of the present invention thereby allow, in addition to mixing liquids based on a rotation of the rotor of a centrifuge, also for precipitating insoluble cell components of liquids or components of a higher density than the liquids themselves.

Embodiments of the present invention can be manufactured especially easily from a plastic material, for example, by employing a injection molding process.

Embodiments of the present invention can be manufactured, for example, as disposable articles.

In summary, contrary to standard reaction vessels, embodiments of the present invention allow for improved blending action of liquids such as, for example, simple centrifuge tubes.

FIGS. 2*a* to 6 show a restoring force that is generated by a restoring means and that is positioned perpendicularly in relation to the axis of rotation of the rotor of the centrifuge. If a mixer is used in a holding means of a rotor of a decay centrifuge, this is typically the case. Using a mixer according to an embodiment of the present invention in a holder of the rotor of a fixed-angle centrifuge, it can be possible that a restoring force $F_r$, which is generated by a restoring means, is not perpendicular in relation to the axis of rotation 140. Correspondingly, a centrifugal force $F_z$ that is generated by the axis of rotation 140 does not directly counteract the restoring force $F_r$. In this instance, only one component of the centrifugal force $F_z$ counteracts the restoring force $F_r$. In other words, embodiments of the present invention can be configured such that the holding means of rotors from decay centrifuges as well as holding means of rotors of fixed-angle centrifuges are received. As restoring force $F_r$ generated in the mixer can therein counteract a centrifugal force that is generated by the rotation of the rotor or against a component of the centrifugal force generated by the rotation of the rotor.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A mixing device comprising:

a centrifuge including a rotor; and a mixer inserted into the rotor of the centrifuge, the mixer including:

a mixing trough;

an obstacle device including at least one obstacle arranged to influence a flow of a liquid present in the mixing trough; and a restorer arranged to generate a restoring force that acts in an opposite direction of at least one component of a centrifugal force generated by a rotation of the rotor; wherein in response to the rotation of the rotor, a spacing between at least one wall section of the mixing trough and the obstacle device is variable such that a liquid that is present in the mixing trough flows around the at least one obstacle of the obstacle device;

in a first phase and at a first angular velocity of the rotor, a first value of the component of the centrifugal force acting in an opposite direction of the restoring force is greater than a value of the restoring force;

in a second phase and at a second angular velocity of the rotor, a second value of the component of the centrifugal force acting in the opposite direction of the restoring force is less than the value of the restoring force;

a first spacing between the at least one wall section of the mixing trough and the obstacle device is greater in the first phase than a second spacing between the at least one wall section of the mixing trough and the obstacle device in the second phase;

in the first phase, the liquid that is present in the mixing trough at least partially flows around the at least one obstacle of the obstacle device in a first direction; and in the second phase, the liquid that is present in the mixing trough at least partially flows around the at least one obstacle device in a second direction that is opposite to the first direction.

2. The mixing device according to claim 1, wherein the obstacle device disposed in the mixing trough.

3. The mixing device according to claim 1, wherein, upon a rotation of the rotor, a spacing between the at least one wall section of the mixing trough and an axis of rotation of the rotor is greater than a spacing between the obstacle device and the axis of rotation of the rotor.

4. The mixing device according to claim 1, wherein the at least one wall section is configured such that, upon incorporation of the mixer in a holder of a rotor of a decay centrifuge and at a maximum decay of the holder at a given angular velocity of the rotor, a spacing between the at least one wall section and the axis of rotation of the rotor varies along a direction of propagation of the at least one wall section.

5. The mixing device according to claim 1, wherein a value of the first angular velocity is greater than a value of the second angular velocity.

6. The mixing device according to claim 1, wherein the wall section of the mixing trough is an elastic membrane, wherein the obstacle device is locked in place in the mixer, and wherein the elastic membrane constitutes the restorer.

7. The mixing device according to claim 6, wherein the elastic membrane is configured such that it bursts open in response to a third given angular velocity of the rotor whose amount is greater than an amount of the first angular velocity and greater than an amount of the second angular velocity.

8. The mixing device according to claim 6, further comprising a piercer that is disposed, upon a rotation of the rotor, radially further outside than the elastic membrane in order to perforate, responding to a given third angular velocity of the rotor whose amount is greater than an amount of the first angular velocity and greater than an amount of the second angular velocity, the elastic membrane of the mixing trough.

9. The mixing device according to claim 1, wherein the restorer includes a first spring.

10. The mixing device according to claim 9, wherein the first spring comprises an elastomer material.

11. The mixing device according to claim 9, further comprising:

a housing, wherein the first spring is arranged between the housing and the mixing trough in order to move the mixing trough in response to the rotation of the rotor inside the housing, and the obstacle device is locked in place on the housing.

12. The mixing device according to claim 9, further comprising:

a housing, wherein the first spring is arranged between the mixing trough and the obstacle device in order to move the obstacle device in response to the rotation of the rotor in relation to the housing, and the mixing trough is locked in place on the housing.

13. The mixing device according to claim 9, wherein the mixing trough comprises at least one passage opening with a lid film in the wall section, wherein the lid film is configured such that it bursts open in response to a given third angular velocity whose amount is greater than an amount of the first angular velocity and greater than an amount of the second angular velocity.

14. The mixing device according to claim 9, comprising a piercer and wherein the mixing trough comprises in the wall section at least one passage opening with a lid film, wherein the piercer is configured such that is perforates the lid film in response to a third angular velocity whose amount is greater than an amount of the first angular velocity and an amount of the second angular velocity.

15. The mixing device according to claim 14, further comprising:

a second spring between the mixing trough and the housing, wherein a spring constant of the second spring is greater than a spring constant of the first spring such that an amount of a holding force generated by the second spring at the first angular velocity and the second angular velocity is greater than amounts of the components of the centrifugal force counteracting the restoring force, and such that at a third angular velocity the amount of the holding force is smaller than an amount of the component of the centrifugal force that counteracts the restoring force in order to create a spacing between the lid film and the piercer at the first angular velocity and the second angular velocity and to insert the piercer into the lid film at the third angular velocity.

16. The mixing device according to claim 1, further comprising:

a chromatographic column, wherein the mixer is arranged to route the liquid that is present in the mixing trough over the chromatographic column, in response to the angular velocity of the rotor.

17. The mixing device according to claim 1, further comprising:

a cylinder-shaped housing with a cover side and a base side located opposite to the cover side, wherein the mixing trough and the obstacle device are arranged inside a cavity of the cylinder-shaped housing.

18. The mixing device according to claim 1, wherein:

the obstacle device includes a plurality of obstacles, and a first spacing between two obstacles from the plurality of obstacles differs from a second spacing between two further obstacles from the plurality of obstacles.

19. The mixing device according to claim 1, wherein:

the obstacle device includes a plurality of obstacles, and the obstacle device is arranged such that, when the mixer is arranged in a holder of a rotor of a decay centrifuge, at a maximum decay of the holder and at a given angular velocity of the rotor, a spacing of a first obstacle from the plurality of obstacles in relation to the axis of rotation of the rotor is different from a spacing of a second obstacle from the plurality of obstacles in relation to the axis of rotation of the rotor.

20. The mixing device according to claim 1, wherein the obstacle device includes a perforated plate, the perforated plate comprising at least one passage opening such that the liquid that is present in the mixing trough flows, in response to the rotation of the rotor, through the at least one passage opening of the perforated plate.

21. The mixing device according to claim 1, further comprising at least one sedimentation cavity.

* * * * *